United States Patent [19]

Poynter

[11] Patent Number: 5,004,122

[45] Date of Patent: Apr. 2, 1991

[54] ARTICLE DISPENSING PACKAGE

[76] Inventor: Timothy M. Poynter, 331 Tusculum Ave., Cincinnati, Ohio 45226

[21] Appl. No.: 298,408

[22] Filed: Jan. 18, 1989

[51] Int. Cl.[5] ..... B65D 83/04

[52] U.S. Cl. ..... 221/155; 221/266

[58] Field of Search ..... 221/24, 155, 266, 302

[56] References Cited

U.S. PATENT DOCUMENTS

| | | | |
|---|---|---|---|
| 2,684,143 | 7/1954 | Obodzinski | 221/266 X |
| 3,077,254 | 2/1963 | Goldfarb | 221/155 X |
| 3,288,329 | 11/1966 | Ketchem | 221/155 |
| 4,120,053 | 10/1978 | Nemirofsky | 2/115 |
| 4,858,756 | 8/1989 | Herrin et al. | 206/45.34 |

*Primary Examiner*—F. J. Bartuska

*Attorney, Agent, or Firm*—Kinney & Schenk

[57] ABSTRACT

A display package is described. It comprises a backing sheet and a blister piece which combine to simulate a vending machine. The upper bowl portion of the simulated vending machine is filled with gum balls and a dispensing mechanism is disposed in the base portion of the simulated vending machine. A knob is rotated to dispense individual gum balls from the package. A breakaway tab provides means for deterring tampering and must be removed in order to dispense the gum balls.

3 Claims, 1 Drawing Sheet

15
2
10
12
14
21
B
26
18
28
3
30
26
32
42
46
20
44
24
40
42
19
34
36
22
53
48
51
38
21
50
2

10
12
16
14
17
B
24
28
18
32
44
46
53
22
51
20
36
48
38
14
16

26
30
28
32
22
20
16
12
17
40
19
24
10
44
18

ARTICLE DISPENSING PACKAGE

The present invention relates to improvements in packaging and more particularly to an improved display package from which articles may be dispensed.

More particularly the present invention relates to an improved package of the so-called blister type comprising a cardboard sheet and a relatively stiff, raised, transparent cover having a peripheral flange which lays against and is secured to the cardboard sheet. Products to be displayed for sale are disposed within the chamber formed by the transparent cover and the cardboard sheet.

Products so packaged may be attractively displayed for sale and are protected from abuse while so displayed, as well as during shipment. A widespread practice is to provide a hole in the upper portion of the cardboard member so that the package may be hung on a hook projecting from a display rack.

Variations are found in blister package constructions, as where the backing sheet is formed of other than cardboard or where a second blistered piece projects through the opposite side of the sheet member and further defines the article receiving chamber.

The object of the present invention is to enhance the effectiveness of blister packages in the merchandising of various articles.

Another object of the present invention is to provide a novelty blister package having means for dispensing articles therefrom.

A further object of the present invention is achieve the foregoing ends in an economical manner.

These ends are attained, in accordance with the broader aspects of the invention, by a display package from which articles may be dispensed. The package comprises a relatively rigid backing sheet and a relatively stiff, blister piece secured thereto. The blister piece is transparent and forms, in part, a chamber in which the articles are disposed. Manually operable means, secured to the backing sheet, are disposed beneath the article chamber and provide for articles to be selectively dispensed from the chamber.

Preferably, the protruding portion of the blister piece is provided with a peripheral flange disposed in a given plane from which the remainder of the blister piece protrude. The flange is then secured to the backing piece to form, in combination therewith, the article receiving chamber. The backing sheet is advantageously formed of cardboard and provided with a hole in its upper end so that the package can be hung the hooks of existing display racks.

A feature enhancing the effectiveness of the present package is found in proving the protruding portion of the blister piece with the outline, in elevation, of an article vending machine, including an upper bowl portion, which comprises the article chamber and a base portion. The dispensing means is then disposed in this base portion. More specifically, the base portion may have an opening in which a housing of the dispensing means may be disposed. A feeder wheel is then rotatably mounted in the housing. A pocket in the feeder wheel is rotated to an upwardly facing direction to receive an article, or articles, from the bowl chamber. The feeder wheel is then rotated to bring the pocket to a lower discharge position to dispense articles from the package. An exteriorly disposed knob is preferable provided to enable rotation of the feeder wheel in the dispensing of articles.

Constructional features are found in the provision of a front plate on the housing which fills the opening and the provision of reversely folded portions of the blister piece to define the side edges of this opening. Additionally, the housing may be provided with centrally disposed, upper passageway forming means leading from the article chamber to the feeder wheel. Further, wings may extend laterally from these passageway forming means to form the bottom of the article chamber. Also, the forming means comprising ribs projecting beneath the front plate, with a bottom wall connecting these ribs. Tab means are advantageously provided between the front plate of the housing and the side walls of the blister piece opening, to hold the dispensing means in assembled relation with the blister piece, with the wings and the discharge passageways ribs engaging the inner surface of the blister piece.

The present package is particularly useful in displaying and dispensing gum balls and similar articles which are generally spherical and of a uniform diameter. To this end it is preferred that the dimensions of the pocket of the feeder wheel be somewhat greater than required for an article to be received therein and the cross section of the upper passageway is somewhat greater than the diameter of the articles whereby individual articles may be dispensed from the package.

Yet another feature of the invention is found is the provision of a break away panel covering the opening, in the base portion of the blister piece, through which articles are dispensed. The break away panel must be removed before articles can be dispensed from the package. This prevents removal of articles from the package while they are being displayed for sale and also serves as a deterrent to tampering with the contents of the package. A pull tab may be provided to facilitate removal of the breakway panel.

The above and other related objects and features of the invention will be apparent from a reading of the following description of a preferred embodiment, with reference to the accompanying drawings, and the novelty thereof pointed out in the appended claims. In the drawing:

Figure 1:
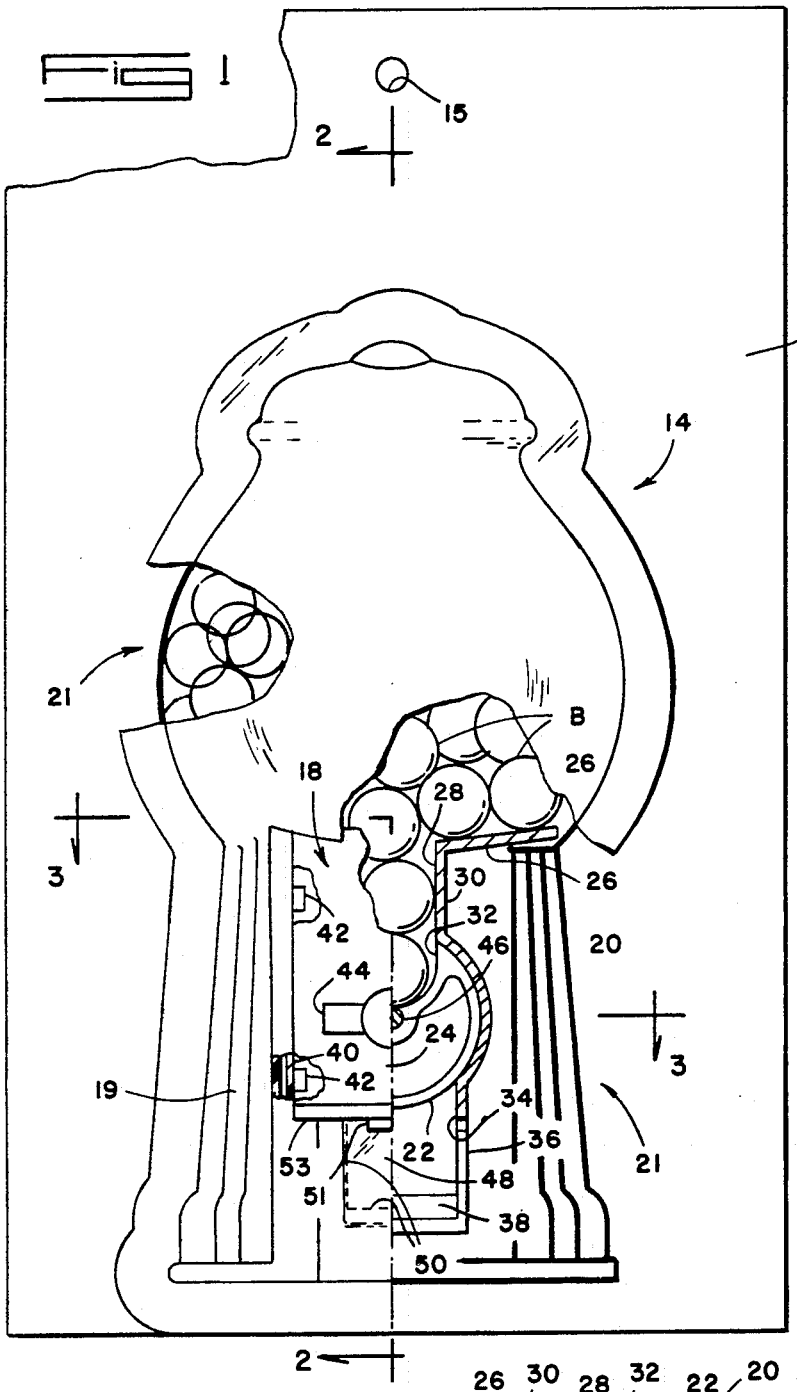
FIG. 1 is an elevation of a display package, embodying the present invention, with portions broken away and in section.
Figure 2:
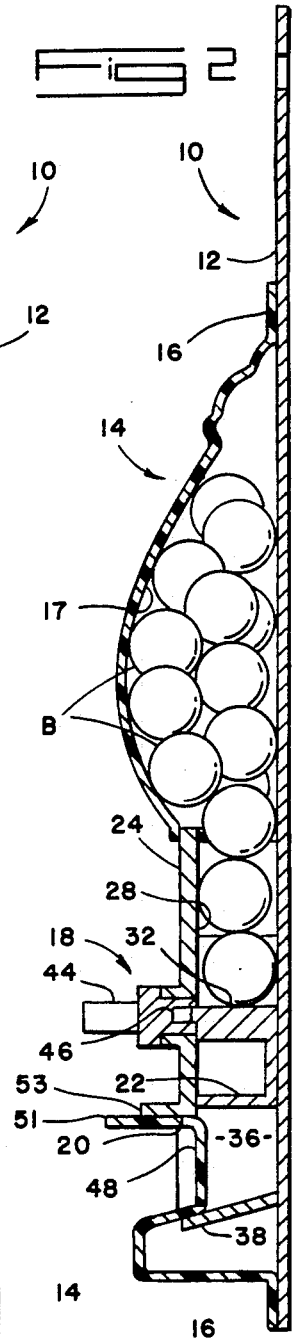
FIG. 2 is a section taken on line 2—2 in FIG. 1.
Figure 3:
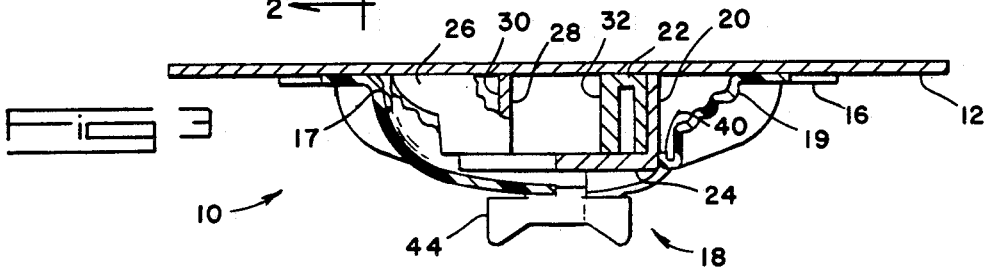
FIG. 3 is a section taken on line 3—3 in FIG. 1.

The package of the present invention is intended for the display and sale of a type of candy known as gum balls. The primary feature provided by this package is the capability of dispensing the gum balls one at a time.

The package, indicated generally by reference character 10, comprises a relatively rigid backing sheet 12, preferably formed of cardboard having a thickness in the order of 0.3 inch. A transparent blister piece 14 has a peripheral flange 16 which lays against and is secured, as by heat sealing, to the backing sheet 12. A hole 15 is formed at the upper end of the backing sheet 12 so that the package 10 may be hung on a hook of a display rack, where it will exhibited to potential customers in a retail outlet.

The blister piece 14 may be formed of a resinous material, such as polyvynalchloride, with a thickness sufficient for it to be relatively stiff, in the order of 8–10 mils. Conventional means may be employed to mold the blister piece to the illustrated configuration.

The protruding portion of the blister piece has the outline of a vending machine of familiar design. The upper portion simulates the glass bowl and lid used in such machines and the lower portion simulates the base of such machines. In essence the protruding portion of the blister piece of the backing sheet provide a three dimensional vertical section of a gum ball machine comprising an article receiving bowl chamber 17, filled with gum balls B, and a base portion 19.

Indicia means in the form of printing on the backing sheet 12 depict the outline of the vending machine, coincident with the outline of the protruding portion of the blister piece. The indicia means also depict gum balls in the bowl portion and certain of the features of the base portion. The broken away portions of the blister piece 14 reveal these indicia means, which are indicated generally by reference character 21.

A dispensing mechanism, indicated generally by reference character 18, is provided in the base portion of the simulated gum ball machine. The dispensing mechanism 18 comprises a housing 20 and a feeder wheel 22 which is rotatable in the housing 20. The housing 20 comprises a front plate 24 which is positioned in an opening in the base portion of the blister piece 14. Wings 26 are angled outwardly and upwardly from the housing 20 to define a bottom for the upper portion of the blister piece and the bowl simulating chamber which it defines. The simulated bowl chamber is filled with gum balls.

The wings 26 are sloped toward a central passageway 28 in the housing 20 which is defined by the front plate 24, the backing sheet 12 and housing ribs 30. The feeder wheel 22 has a pocket 32 which is alignable with the passageway 28 and a discharge passageway 34 formed by housing ribs 36, the front plate 24 and the backing sheet 12. The discharge passageway 34 has an outwardly sloped bottom wall 38 extending between the ribs 36.

Structural integrity of the package is enhanced by the provision of reversely folded portions 40 of the blister piece to define the upper side edges of the opening in which the front plate 24 is registered. Further rigidity is provided by the lower portion of the bowl portion of the blister piece overlying the upper portion of the front plate 24.

The dispensing mechanism 18 is firmly secured to the blister piece 14 by tabs 42 which project inwardly from the reversely folded portions 40 and underlie the front plate 24. The wings 26 and discharge passageway ribs 36, or other portions of the housing 20, are thus held against the inner surface of the blister piece 14. By so securing the dispensing mechanism to the blister piece, it is also secured to the backing sheet 12, without necessarily being bonded thereto. This feature also provides a convenient subassembly which facilitates manufacture of the package.

A winged knob 44 is secured to a pin 50 which projects from the feeder wheel 22. The knob 44 is manually rotated to align the pocket 32 in the wheel 22 with the central passageway 28.

The cross sectional outline of the central passageway 28 and dimensions of the pocket 52 are "somewhat greater" than the diameter of the gum balls. The term "somewhat greater" denotes that the size of the pocket 52 is sufficient for a gum ball to be received therein and yet not larger enough for a second gum ball to be caught when the feeder wheel is rotated. It also denotes that the cross section of the passageway is sufficient to permit gum balls to pass freely therethrough, without being so large that a second gum ball will be caught by the side of the pocket 32 when the feeder wheel is rotated, all to the end that individual gum balls may be dispensed.

The front opening of the discharge passageway, beneath the front plate 24, is initially blocked by a break away panel 48. The break away panel substantially seals the bowl chamber 17 and the chamber of the base portion 19. Thus effective means for the deterrence of tampering are provided. Also, the knob 44 may be freely rotated to demonstrate how the dispensing mechanism operates while rendering it impossible for gum balls to be discharged from the package. (Note that the thickness) of the panel 48 is exaggerated in the drawing. The actual thickness permits a gum ball to pass freely to the bottom of the discharge passageway 34).

After the display package is purchased, the panel 48 is readily removed by tearing it along score lines 50, indicated by dotted lines in the drawing. To facilitate removal of the break away panel 48, a pull tab 51 is provided at its upper end. The tab 51 may be gripped and pulled outwardly to effect removal of the panel 48. The pull tab is economically provided in forming the opening for the dispensing mechanism 18 by leaving the tab extension integral with the panel 48. Then during assembly of the dispensing mechanism, the tab 51 is bent outwardly as the dispensing mechanism is mounted as above described. After assembly a ledge 53, at the bottom of the housing 20, positions the tab 51 for ready gripping and removal of the break away panel 48.

While the described embodiment for packaging gum balls, or other relatively large, spherical articles of generally uniform diameter has particular advantages, the concepts herein are also applicable to the packaging of other articles, including relatively small articles which might more effectively be dispensed several at a time rather than individually.

Similarly, the invention, in its broader aspects, is not limited to a blister piece which simulates a vending machine and other configurations of the blister piece could also be employed.

Further, while the preferred material for the backing sheet 12 is cardboard, other materials having similar characteristics could be employed.

The above and other variations in the described embodiment will occur to those skilled in the art within the spirit and scope of the invention as defined in the following claims.

Having thus described the invention, what is claimed as novel and desired to be secured by Letters Patent of the United States is:

1. A display package from which articles may be dispensed, said package comprising a relatively rigid backing sheet, a transparent, relatively rigid, blister piece secured to said backing sheet and having a protruding portion which defines, in part, a chamber in which the articles are disposed, the protruding portion of the blister piece having a flange disposed in a given plane from which the remainder of the blister piece protrudes, said flange being secured to the backing sheet, whereby the blister piece, in combination with the blister sheet forms the article chamber, the protruding portion of the blister piece having, in elevation, the outline of an article vending machine, including an upper bowl portion, which comprises the article chamber, and a base portion, the base portion of the blister piece having an opening formed therein, and manually operable means, mounted on the backing sheet and disposed beneath the article chamber, for dispensing articles therefrom, the dispensing means comprising a housing registered with the opening in the base portion and disposed within said base portion, and a feeder wheel rotatably mounted in said housing and having a pocket, which, in an upper position receives an article from the article chamber with said passageway, said feeder wheel being rotatable to a bring the pocket to a lower discharge position, in which the article is discharged through the opening in the base portion of the blister piece, whereby the article may be dispensed from the package, said housing having a front plate disposed in the opening in the blister piece and the side edges of said opening being formed by reversely folded portions of the blister piece to provide structural strength.

2. A display package as in claim 1 wherein the backing sheet is formed of cardboard and has a hole formed at its upper end to permit mounting of the package on a display hook, said housing further comprises central passageway forming means leading from the article chamber to the feeder wheel, and wings projecting laterally from said passageway and forming the bottom of said article chamber.

3. A display package as in claim 2 wherein said housing further comprises centrally disposed discharge passageway forming means comprising ribs projecting beneath said front plate and connected by a bottom wall and further comprising tab means, between the front plate and the side walls of the blister piece opening, for holding the dispensing means in assembled relation with the blister piece, with the wings and the discharge passageway ribs engaging the inner surface of the blister piece.

* * * * *